US006551125B2

(12) United States Patent
Ikeda et al.

(10) Patent No.: US 6,551,125 B2
(45) Date of Patent: Apr. 22, 2003

(54) CONNECTING STRUCTURE FOR A PORTABLE ELECTRONIC DEVICE CORD

(75) Inventors: Akihiro Ikeda, Iizuka (JP); Naohiko Yoshizumi, Iizuka (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 09/324,439

(22) Filed: Jun. 2, 1999

(65) Prior Publication Data

US 2001/0018289 A1 Aug. 30, 2001

(30) Foreign Application Priority Data

Nov. 13, 1998 (JP) ..... 10-324168

(51) Int. Cl.[7] ..... H01R 13/58; H01R 13/60
(52) U.S. Cl. ..... 439/456; 439/450; 439/527
(58) Field of Search ..... 439/456, 450, 439/531, 576, 527

(56) References Cited

U.S. PATENT DOCUMENTS 4,081,659 A * 3/1978 Kemp ..... 219/296
4,875,875 A * 10/1989 Archer et al. ..... 439/401
5,507,667 A * 4/1996 Hahn et al. ..... 439/501
5,596,479 A * 1/1997 Campbell et al. ..... 361/463
5,721,646 A * 2/1998 Catlin et al. ..... 359/865

* cited by examiner

*Primary Examiner*—Lynn D. Feild
*Assistant Examiner*—Chandrika Prasad
(74) *Attorney, Agent, or Firm*—Ladas & Parry

(57) ABSTRACT

A connecting structure for a portable electronic device cord comprises a substantially arc-shaped binding member having an outwardly convex surface projecting toward the interior of the device case from an opening in the case through which the cord passes, the binding member forming an integrated single unit with an interior wall of the case. The cord, one end of which is secured to a board within the device, is wrapped around the surface of the arc-shaped binding member and thereby bent at substantially a right angle as it extends through the binding member by which it is securely held and out the case opening. By firmly securing the cord to the case in this fashion the need for an external bush is eliminated and the cord can be wrapped snugly around the device without bending at sharp angles, thus increasing ease of transport and reducing the possibility of the cord breaking loose from the device.

6 Claims, 4 Drawing Sheets

CONNECTING STRUCTURE FOR A PORTABLE ELECTRONIC DEVICE CORD

BACKGROUND OF THE INVENTION

1. Field of the Invention

The present invention relates generally to a structure for connecting a cord of a portable electronic device to a case of that device.

2. Description of the Related Art

Typically, an electronic device such as an AC adapter for charging a portable telephone, etc., is equipped with a power cord.

The conventional structure for connecting the cord to the portable electronic device, such as that for the AC adapter 1 and main unit connector 2 shown in FIG. 7, involves providing a flexible bush 6*a*, 6*b* on that part of the cord 3*a*, 3*b* adjacent to and extending directly outward from the case 4 of the AC adapter or the case 5 of an electronic device main unit.

When transporting the electronic device, such as the AC adapter shown in FIG. 8, the cord 3*a* is typically wrapped or wound around the case 4 of the AC adapter 1 so as to be out of the way. In so doing, the bush 6*a* flexes so as to accommodate the bending of the cord 3*a* as it is wrapped or wound around the case 4.

However, when the cord 3*a* is wrapped around the case 4 as described above the bush 6*a* bulges outward, interfering with the snug wrapping of the cord 3*a* and hence the convenient transport of the device.

Additionally, although the bush 6*a* is flexible, repeated wrapping and unwrapping of the cord 3*a* can cause the cord 3*a* to break off from the case 4 at the location of the bush 6*a*.

SUMMARY OF THE INVENTION

Accordingly, it is an object of the present invention to provide a connecting structure for a portable electronic device cord in which the problems described above are solved.

The above-described object of the present invention is achieved by a connecting structure for a portable electronic device cord comprising a binding member for binding the cord to the case.

Additionally, the above-described object of the present invention is also achieved by the connecting structure as described above, wherein the binding member is integrally provided within the case so as to form a single unit.

According to the invention described above, by providing a binding member for securely binding the cord to the case inside the case itself the need for an external flexible bush is eliminated, thus improving the compactness with which the cord may be wrapped around the electronic device case and thereby improving the ease with which the device is transported.

Additionally, the above-described object of the present invention is also achieved by the connecting structure as described above, wherein the binding member has an outwardly convex surface and the cord is wrapped around the binding member at substantially a right angle.

According to the invention described above, by wrapping the cord around the outwardly convex binding member the cord, when wrapped around the device case, describes a substantially arc-like form with no sharp bends, thus reducing the possibility of the cord being broken off from the case.

Additionally, the above-described object of the present invention is also achieved by the connecting structure as described above, wherein a flexible buffer member is provided at least between the cord and the binding member.

According to the invention described above, by providing a flexible buffer member between at least the cord and the binding member the cord can be more securely attached to the case and the possibility of the cord being broken off from the case can be reduced.

Additionally, the above-described object of the present invention is also achieved by the connecting structure as claimed in claim 1, wherein the cord is knotted within the case.

According to the invention described above, by knotting the cord within the case the possibility of the cord being broken off from the case can be reduced.

Other objects, features and advantages of the present invention will become more apparent from the following detailed description when read in conjunction with the accompanying drawings.

DESCRIPTION OF THE PREFERRED EMBODIMENTS

A detailed description will now be given of an embodiment of a portable electronic device cord connecting structure according to the present invention, with reference to FIG. 1 through FIG. 5.

Figure 1:
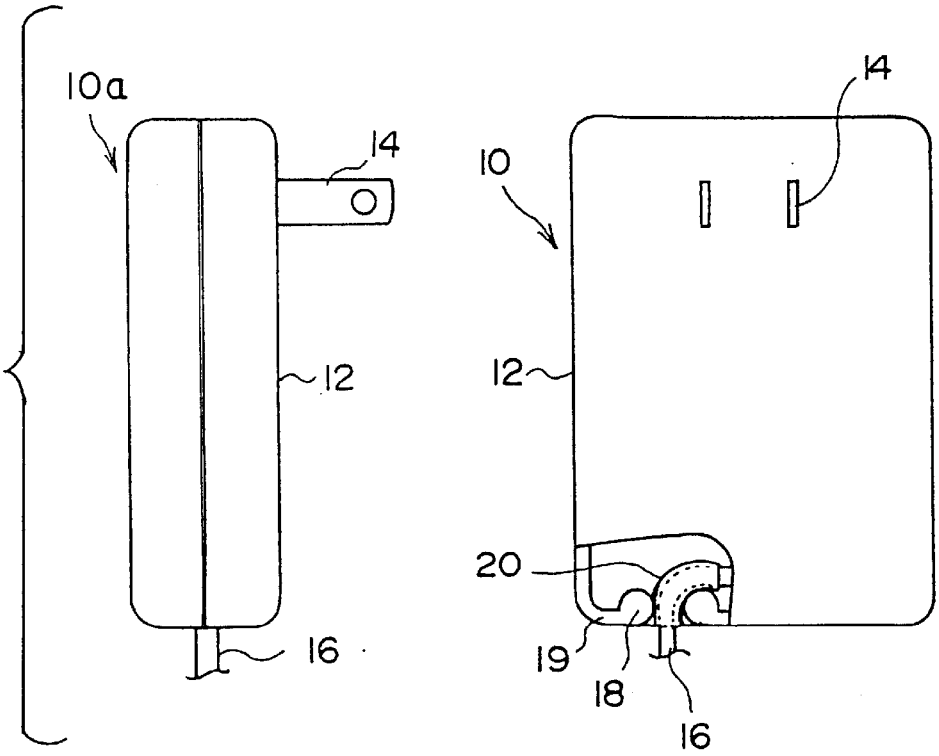
FIG. 1 is a diagram showing side and partial cutaway views of a first embodiment of a connecting structure according to the present invention.

FIG. 1 is a diagram showing side and partial cutaway views of a first embodiment of a connecting structure according to the present invention. As shown in FIG. 1, an AC adapter 10 has a case 12, a plug 14, a cord 16 to be connected to the main unit and, as shown in the partial cutaway, a binding member 18 for binding the cord 16 to the case 12. The case 12 houses a DC converter board not shown in the diagram. The plug 14 is provided on one side of the case 12. An opening is formed in the case 12 where the cord 16 is provided. The binding member 18 is formed so as to have an outwardly convex surface projecting toward the interior of the case 12, in such a way that the cord 16, when wrapped around the surface of the binding member 18, bends in a substantially arc-shaped curve.

Additionally, the cord, one end of which is connected to the board not shown in the diagram, is covered by a flexible, tube-like buffer member 20. The buffer member 20 may be composed of a flexible resin, and in particular, a polyolefin resin or other heat-shrinkable material, with the buffer member being heat-shrinkably formed on the cord 16, is desirable.

The cord 16 is restrained by the binding member 18 at the point at which the cord 16 is covered by the insulating member 20. The cord 16 is bent or wrapped around the binding member 18 at substantially a right angle and attached to the DC converter board.

A description will now be given of the operation of this first embodiment of the AC adapter cord connecting structure.

Figure 2:
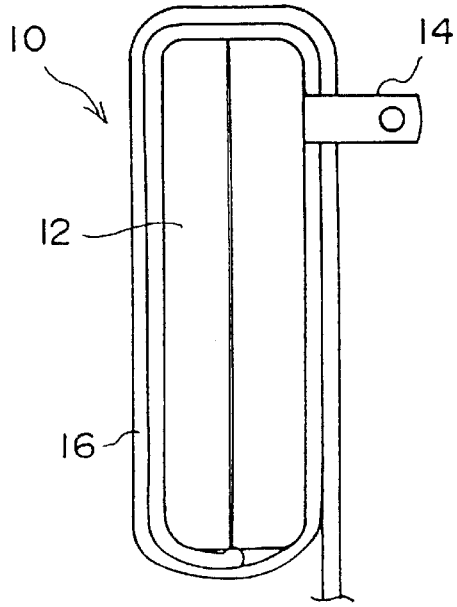
FIG. 2 is a diagram of a side view of an AC adapter having a first embodiment of a connecting structure according to the present invention, showing a state in which the cord is wrapped around the adapter.

FIG. 2 is a diagram of the left side of an AC adapter having a first embodiment of a connecting structure according to the present invention, showing a state in which the cord is wrapped around the adapter during transport.

It should be noted that the cord 16 is bound to the case 12 within the case proper 12 and that the section of the cord 16 adjacent to and extending directly outward from the case 12 is not provided with a projecting portion such as the conventional bush. As a result, the cord 16 can be wrapped flush against the exterior of the case 12, thus making transport easier.

Additionally, the cord 16 is wrapped about the binding member 18 so as to describe substantially an arc shape. As a result, the cord is not bent at a sharp angle and thus the possibility of breakage is reduced.

It should be noted that one end of the cord 16 is bent at substantially a right angle and held securely between the binding member 18 and the buffer member 20 so as to prevent the cord from coming loose.

Figure 3:
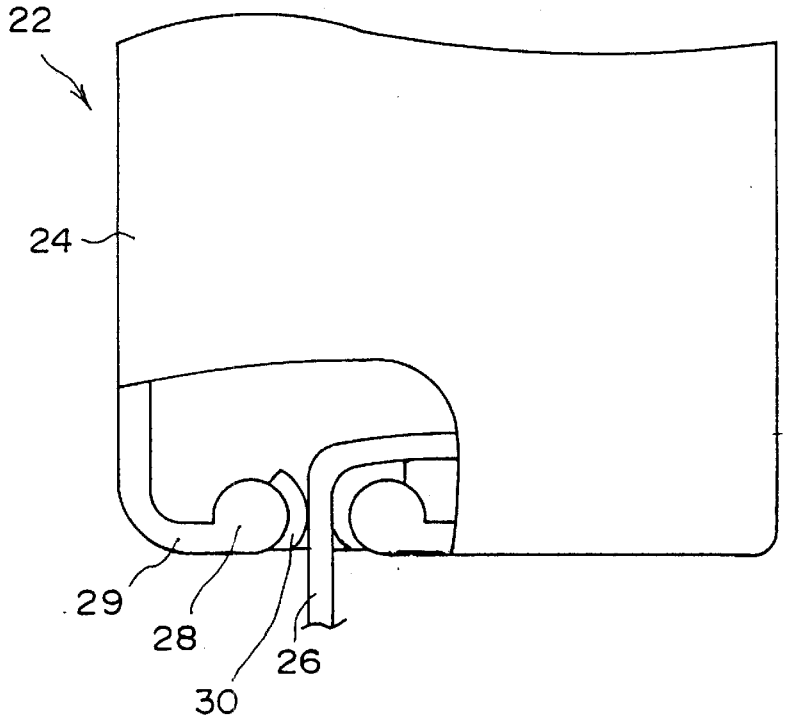
FIG. 3 is a partial cutaway view of an AC adapter showing a first variation of a first embodiment of a connecting structure according to the present invention.

FIG. 3 is a partial cutaway view of an AC adapter showing a first variation of a first embodiment of a connecting structure according to the present invention. As shown in the drawing, the AC adapter 22 has a case 24, a cord 26 and a binding member 28 for binding the cord 26 securely to the case 24.

A hole is formed in one wall 29 of the case 24 at which the cord 26 is provided. The binding member 28 is formed so as to have an outwardly convex surface projecting toward the interior of the case 24 and forms a single unit with the case wall 29. As a result, the cord 26, when wrapped around the surface of the binding member 28 bends in a substantially arc-shaped curve.

Additionally, substantially the entire outwardly convex surface of the binding member 28 is covered with a flexible buffer material 30.

The cord 26 is held in place by the binding member 28 covered by the flexible buffer member 30. The cord 26 is wound around the binding member at substantially a right angle and the end of the cord is attached to a built-in board not shown in the diagram.

The first variation of the first embodiment of the connecting structure according to the present invention as described above achieves the same effect as the first embodiment of the connecting structure according to the present invention.

Figure 4:
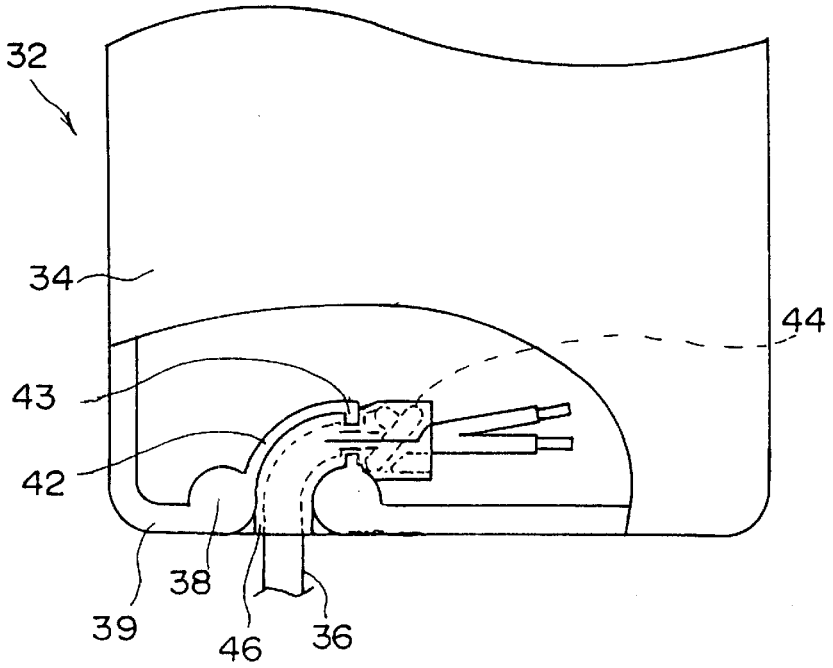
FIG. 4 is a partial cutaway view of an AC adapter showing a second variation of a first embodiment of a connecting structure according to the present invention.

A description will now be given of a second variation of the first embodiment of a cord connecting structure according to the present invention with reference to FIG. 4. FIG. 4 shows a partial cutaway view of an AC adapter showing a second variation of a first embodiment of a connecting structure according to the present invention. The AC adapter 32 has a case 34, a cord 36, and a binding member 38 for binding the cord 36 to the case 34.

A hole is formed in one wall 39 of the case 34 at which the cord 36 is provided. The binding member 38 is formed so as to have an outwardly convex surface projecting toward the interior of the case 34 and forms a single unit with the case wall 39. A cylindrically shaped holding member 42 curved at substantially a right angle for bending the cord 36 at substantially a right angle and holding the cord 36 in place at substantially that right angle is extended from the binding member 38. A projection 43 is formed at the tip of the holding member 42 so as to more securely hold the cord 36 in place.

Additionally, a knot 44 is formed in the cord 36 near the end of the cord 36 connected to the built-in board not shown in the diagram. The end of the cord 36, including the knot 44, is covered by a flexible buffer member 46.

The cord 36 is secured firmly in place by the binding member 38 at the location at which the cord is covered by the flexible buffer material 46, with the projection 43 at the tip of the holding member 42 biting into the buffer material 46 so as to hold the cord 36 firmly in place.

The second variation of the first embodiment of the connecting structure according to the present invention as described above achieves the same effect as the first embodiment of the connecting structure according to the present invention. Additionally, by forming a knot 44 in the cord 36 and having the projection 43 on the holding member 42 bite into the buffer material 46 covering the cord 36, the breaking off of the cord from the case can be more securely prevented.

Figure 5:
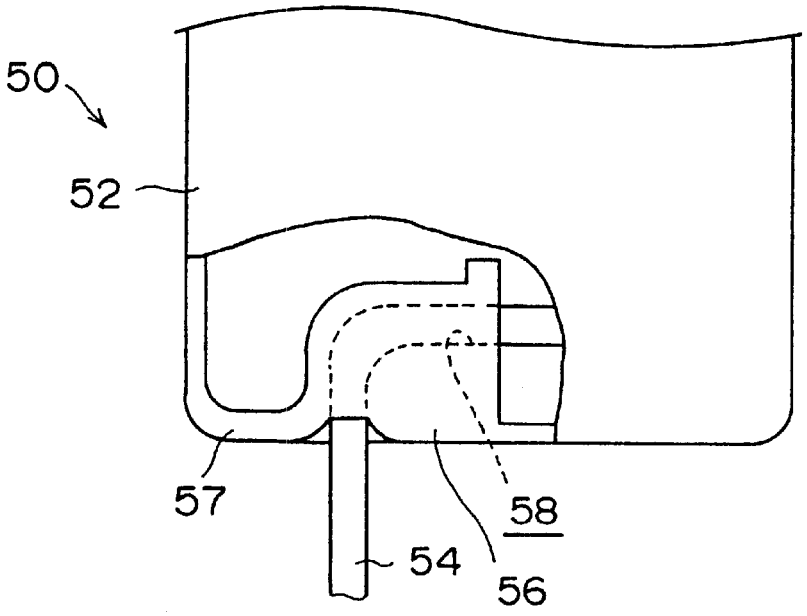
FIG. 5 is a partial cutaway view of an AC adapter showing a third variation of a first embodiment of a connecting structure according to the present invention.

A description will now be given of a third variation of the first embodiment of a cord connecting structure according to the present invention, with reference to FIG. 5. FIG. 5 is a partial cutaway view of an AC adapter showing a third variation of a first embodiment of a connecting structure according to the present invention. The AC adapter 50 has a case 52, a cord 54 and a binding member 56 for binding the cord 54 to the case 52.

A hole is formed in one wall 57 of the case 52 at which the cord 54 is provided. The binding member 56 forms a single unit with the case wall 57. A through-hole aperture portion 58 describing a one-quarter circle arc is formed on the binding member 56. The portion of the through-hole aperture portion 58 through which the cord 54 passes is expanded in an arc shape, with an opening at the hole in the case 52 at which the cord 54 is provided.

The end of the cord 54 that is connected to the built-in board not shown in the diagram is inserted into and through the through-hole aperture portion 58 and secured thereby.

The third variation of the first embodiment of the connecting structure according to the present invention as described above achieves the same effect as the first embodiment of the connecting structure according to the present invention.

A description will now be given of a second embodiment of the connecting structure according to the present invention.

Figure 6:
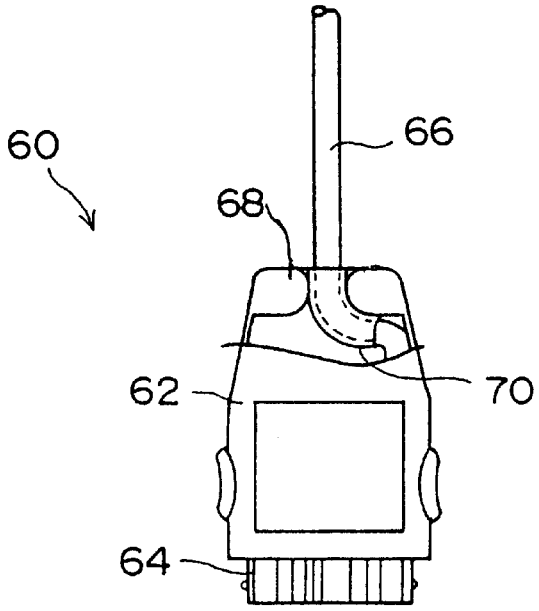
FIG. 6 is a partial cutaway view of a connecting structure connected to a main unit according to a second embodiment of the present invention.
Figure 7:
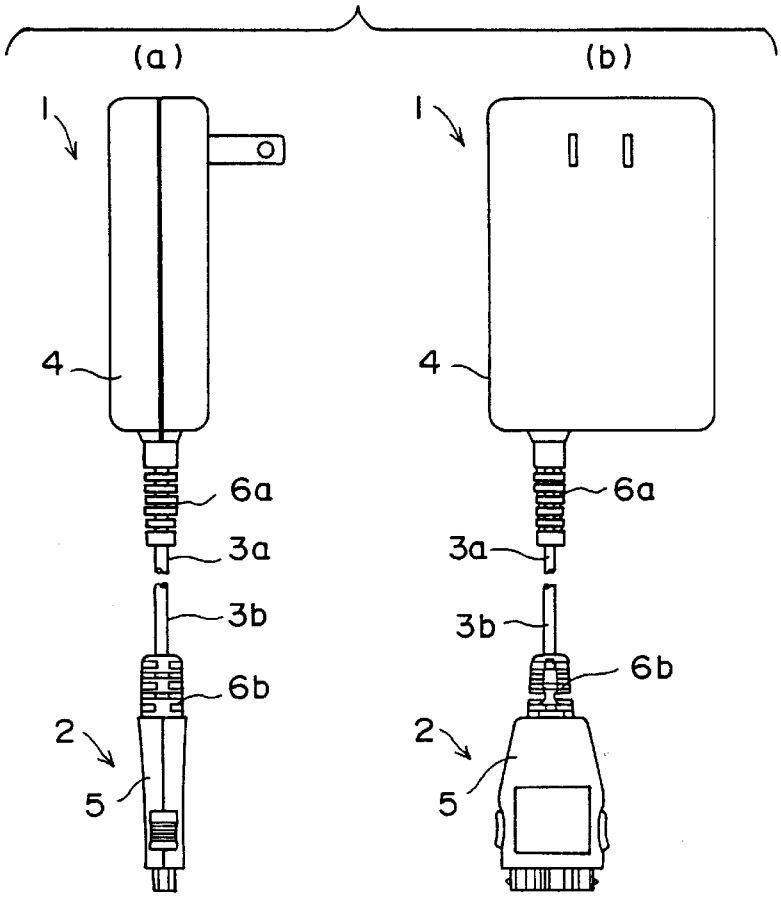
FIG.7 (PRIOR ART)
FIG. 7 is a diagram of side and front views of a conventional AC adapter cord connecting structure.
Figure 8:
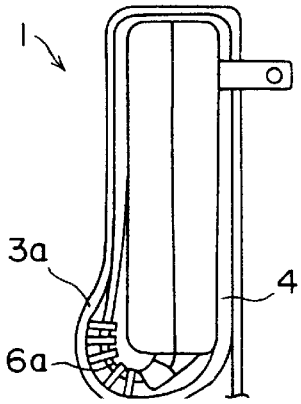
FIG.8 (PRIOR ART)
FIG. 8 is a side view of a conventional AC adapter in a state in which the cord is wrapped around the adapter.

FIG. 6 is a partial cutaway view of a connecting structure connected to a main unit according to a second embodiment of the present invention. The main unit connector 60 has a case 62, a connection terminal 64, a cord 66 and a binding member 68 for binding the cord 66 to the case 62.

The connection terminal 64 for connecting to the main unit is provided on the case 62. A hole is provided on an edge of a side of the case 62 opposite the side on which the connection terminal 64 is provided. On the interior side of the hole a binding member 68 having an outwardly convex surface toward the interior of the case 62 is provided, with the binding member 68 forming a single unit with the wall of the case 62. As a result, the cord 66 is bent in substantially an arc when wrapped around the binding member 68.

The cord 66 is held in place by the binding member 68 covered by a flexible buffer member 70. The cord 66 is wound around the binding member 68 at substantially a right angle and an end of the cord is attached to a built-in board not shown in the diagram.

The second embodiment of the cord connecting structure according to the present invention as described above achieves the same effect as the first embodiment of the cord connecting structure according to the present invention.

The above description is provided in order to enable any person skilled in the art to make and use the invention and sets forth the best mode contemplated by the inventors of carrying out their invention. The present invention is not limited to the specifically disclosed embodiments and variations, and modifications may be made without departing from the scope of the present invention.

The present application is based on Japanese priority application No. 10-324168 filed on Nov. 13, 1998, the entire contents of which are hereby incorporated by reference.

What is claimed is:

1. A portable electronic device cord connecting structure comprising:

a case having a plurality of side walls;

a cord;

a binding member for binding the cord to the case, the binding member being integral with the case so as to form a single unit and to form a part of an outer wall of the case, and the biding member including at least one portion having an outwardly convex surface that extends toward an inner space of the case, and the cord is bent around the binding member within the inner space of the case and is drawn from only one of the plurality of side walls of the case so as to be substantially perpendicular to said one of the plurality of side walls;

a flexible buffer member provided to cover a portion of the cord;

a holding member extending from the binding member and configured to bend the cord at a substantially right angle; and a projection disposed at an end of the holding member to bite the flexible buffer member so as to hold the cord securely.

2. The portable electronic device cord connecting structure as claimed in claim 1, wherein the flexible buffer member is provided at least between the cord and the binding member.

3. The connecting structure as claimed in claim 1 wherein said cord extends through an aperture in said outer wall of the case defined by said binding member, said binding member surrounding said aperture.

4. The connecting structure as claimed in claim 1 wherein said cord further comprises a buffer member shaped, configured and arranged to surround said cord so as to hold said cord securely and thereby prevent the cord from coming loose.

5. The connecting structure of claim 1 wherein the flexible buffer member is disposed around an aperture in said outer wall of the case and between the binding member and the cord.

6. The portable electronic device cord connecting structure of claim 1, wherein the cord is held securely with the binding member, the holding member and the projection at a location where the portion of the cord is surrounded by the flexible buffer member.

* * * * *